United States Patent [19]

Pearl

[11] Patent Number: 4,542,672

[45] Date of Patent: Sep. 24, 1985

[54] SHEET MATERIAL CONVEYOR LOADING APPARATUS

[75] Inventor: David R. Pearl, West Hartford, Conn.

[73] Assignee: Gerber Garment Technology, Inc., South Windsor, Conn.

[21] Appl. No.: 557,541

[22] Filed: Dec. 2, 1983

[51] Int. Cl.[4] ..... D06H 7/00

[52] U.S. Cl. ..... 83/409; 83/217; 83/277; 83/451; 83/455; 83/925 CC; 226/93; 226/162; 226/171

[58] Field of Search ..... 83/374, 375, 379, 217, 83/382, 390, 451-454, 455, 155, 461, 925 CC, 276, 277, 206; 198/486, 740; 271/190; 226/171, 93, 162, 163

[56] References Cited

U.S. PATENT DOCUMENTS

| | | | |
|---|---|---|---|
| 3,207,019 | 9/1965 | Vanzo | 83/277 |
| 3,873,014 | 3/1975 | Matsuhisa | 226/162 |
| 4,176,566 | 12/1979 | Patterson | 83/925 CC |
| 4,322,993 | 4/1982 | Stumpf | 83/925 CC |
| 4,476,756 | 10/1984 | Pearl et al. | 83/925 CC |

*Primary Examiner*—James M. Meister
*Assistant Examiner*—John L. Knoble
*Attorney, Agent, or Firm*—McCormick, Paulding & Huber

[57] ABSTRACT

A layup of sheet material clamped to a conveyor by a conveyor loading apparatus is pulled by and onto the conveyor from an adjacent supply table. The loading apparatus includes a clamping carriage assembly straddling the conveyor and supported for free rolling movement relative to the conveyor. Fluid motors mounted on the clamping carriage move a clamping bar from a released position into clamping engagement with the layup to clamp it between the conveyor surface and the clamping bar and couple the clamping carriage to the conveyor to move with the conveyor. A flexible hose wound on a pay-off reel mounted on the clamping carriage and spring biased toward wound position supplies pressure fluid to the fluid motors and biases the clamping carriage toward a retracted position near the supply table end of the conveyor when the clamping bar is in its released position.

14 Claims, 7 Drawing Figures

SHEET MATERIAL CONVEYOR LOADING APPARATUS

BACKGROUND OF THE INVENTION

This invention relates in general to sheet material conveyor loading apparatus and deals more particularly with improvements in apparatus of the type wherein sheet material to be loaded onto a belt conveyor is pulled by the conveyor from an adjacent supply table. In an apparatus of the aforedescribed general type some means is provided for clamping or otherwise releasably securing to the conveyor a portion of the sheet material to be loaded so that the sheet material travels onto and with the conveyor as it is pulled from the supply table. In some instances it is essential that the sheet material be loaded and advanced with precision. This is particularly true in a conveyorized programmable apparatus for working on sheet material wherein a tool moves in working relation to sheet material supported on the conveyor in response to command signals received from a programmable controller. In a machine of the aforedescribed general type, which may, for example, be used to cut pattern pieces from successive segments of long lengths of sheet material, it is essential that the material be loaded onto and advanced with the conveyor with precision, so that proper relationship between pattern pieces cut from successive segments of the material is maintained to avoid overlapping cuts and resulting waste. If the machine includes a vacuum holddown conveyor for holding sheet material in fixed position on the conveyor while it is worked upon, it is usual to utilize the vacuum holddown function of the conveyor to releasably secure at least a portion of the sheet material to the conveyor to move with the conveyor during the conveyor loading and advancing mode. However, application of vacuum holddown force to the conveyor belt during the material moving mode generally increases frictional engagement between portions of the conveyor belt and associated portions of its supporting structure, which results in a corresponding increase in the power required to move the conveyor. When vacuum is applied to the holddown conveyor during the material moving mode it also becomes more difficult to precisely control conveyor movement for proper material positioning. Further, a zoned vacuum holddown conveyor is usually required for such an apparatus, which substantially increases the cost of producing the apparatus.

Accordingly, it is the general aim of the present invention to provide an improved apparatus for loading sheet material onto a conveyor. A more particular aim of the invention is to provide an improved loading device suitable for use with a vacuum holddown conveyor to secure sheet material to the conveyor during the material moving mode whereby to eliminate the need for application of vacuum to the conveyor while the conveyor is in motion.

SUMMARY OF THE INVENTION

An apparatus for working on sheet material includes conveying means for advancing sheet material received from the spreading table and conveyor loading means for releasably securing sheet material to the conveyor to move with the conveyor and from the spreading table onto the support surface. In accordance with the present invention, the conveyor loading means comprises a clamping assembly which includes a clamping carriage, means for supporting the clamping carriage for free longitudinal directional movement with and relative to the conveyor, a clamping element carried by the clamping carriage, and means for moving the clamping element toward the support surface of the conveyor and to a clamped position and away from the support surface and to a released position. In the clamped position the clamping element is engageable with sheet material on the support surface to clamp the sheet material to the support surface and thereby couple the clamping carriage to the support surface to move with the support surface. In the released position the clamping element is out of engagement with the sheet material and the clamping carriage is uncoupled from the conveyor. The clamping carriage is advanced by and with the conveyor from a retracted position to an advanced position when the clamping element is in its clamping position. A biasing means is provided for urging the clamping carriage toward a retracted position when the clamping element is in released position.

DETAILED DESCRIPTION OF PREFERRED EMBODIMENT

Figure 1:
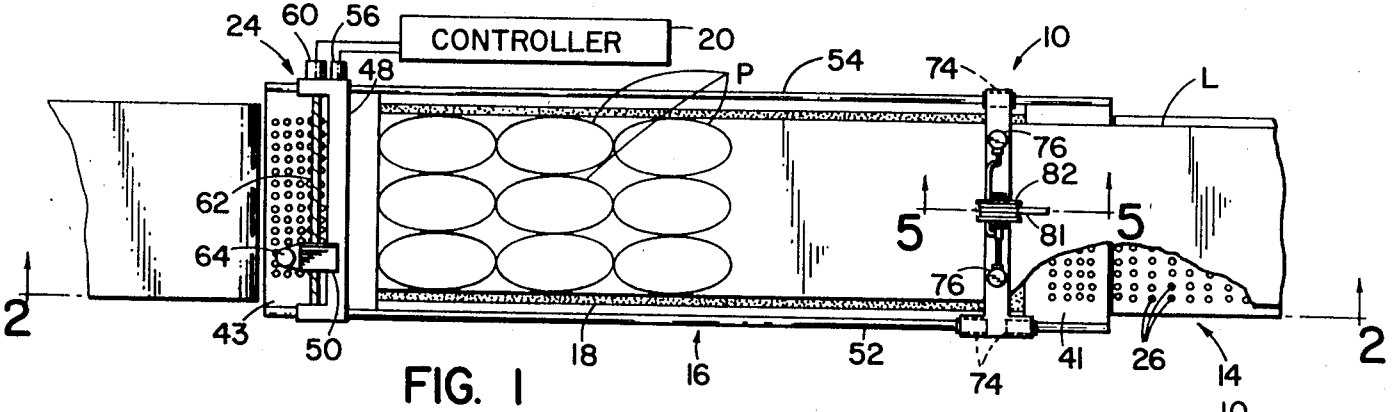
FIG. 1 is a plan view of a conveyorized machine for working on sheet material and having an improved conveyor loading apparatus embodying the present invention.

The present invention is now illustrated and described with reference to an automatically controlled machine for working on sheet material, indicated generally at 10, which includes a conveyor loading apparatus embodying the invention and designated generally by the numeral 12. The illustrated machine 10 is a programmable cutting machine may be used to cut pattern pieces P, P, which vary in size and shape, from a layup of woven or nonwoven fabrics, synthetics, plastics, paper, leather, and other materials. The layup may comprises a single sheet of material or a plurality of sheets arranged in vertically stacked relationship, such as the illustrated layup L. The layup L may be formed by simultaneously drawing a plurality of sheets of material from corresponding bolts of material. However, the illustrated layup L is preferably formed by a cloth spreader (not shown) on a spreading table 14 adjacent one end of the cutting machine 10.

The illustrated machine 10 generally comprises a vacuum holddown table, indicated generally at 16, which includes a motor driven vacuum holddown belt conveyor 18 for compressing and holding a layup, such as the layup L, in fixed position within a working region of the table while a blade moves in cutting relation to the material in response to signals received from a programmable controller, indicated by the numeral 20. The loading apparatus 12 cooperates with the conveyor 18 to grip the layup, pull it from the spreading table 14 and advance it to the working region of the vacuum table 16 where the cutting operation is performed by a cutting tool which includes a reciprocating cutting blade 22, shown in FIG. 2, mounted on a movable tool carriage assembly, indicated generally at 24. The tool carriage assembly 24 moves the blade 22 longitudinally and transversely of the vacuum table 16 in response to command signals from the controller 20 which signals also cause the blade to turn about its axis to cut pattern pieces P, P from the layup. Preferably, and as shown, the apparatus 10 also includes a discharge conveyor, indicated at 25, for removing cut pattern pieces P, P and surrounding scrap material from the vacuum holddown table 16 for later separation. After separation from the scrap material, the pattern pieces P, P are preferably tied in bundles for storage or delivery to other work stations for further processing.

Considering now the machine 10 and its associated spreading table 14 in further detail, the spreading table preferably comprises an air bearing table, which facilitates shifting movement of a layup, such as the layup L, from the spreading table to the vacuum conveyor 18. The surface of the table 14 has perforations 26, 26, formed therein which communicate with a chamber 28 below the table surface. An air pump 29 supplies a large volume of low pressure air to the chamber 28 which escapes through the perforations 26 to form an air bearing between the surface of the spreading table and the lower surface of the layup L. This air bearing supports the layup to move with minimal friction from the spreading table 16 onto the vacuum holddown table 16.

The illustrated vacuum holddown conveyor 18, which forms a part of the vacuum holddown table 16, has an air permeable conveyor belt formed by a plurality of bristle blocks 30, 30. Each bristle block 30 has a perforated base and bristles which project from the base and terminate at free ends to define the supporting surface of the conveyor 18. The bristle blocks are secured to grid plates or perforated sections 32, 32, hingedly connected to each other by transversely extending hinge pins 33, 33 to form an articulated endless conveyor belt which carries the bristle blocks. A set of transversely spaced apart sprockets or star wheels 34, 34, (one shown in FIG. 2) support the conveyor belt at its loading end. A similar set of star wheels or sprockets 36, 36, support discharge end of the conveyor belt. A drive motor 38 drivingly connected to the sprockets 36, 36, drives the conveyor 18 in response to command signals received from the programmable controller 20. A conveyor of the type hereinbefore described is further illustrated and described in my U.S. Pat. No. 4,328,726 on APPARATUS AND METHOD FOR WORKING ON SUCCESSIVE SEGMENTS OF SHEET MATERIAL, issued May 11, 1982, assigned to the assignee of the present invention, and hereby adopted by reference as part of the present disclosure.

The vacuum holddown table 16 further includes a generally rectangular tank-like enclosure indicated generally at 40 which substantially envelopes the conveyor 18 except for a portion of its upper run which defines the surface on which the illustrated layup L is supported. An air bearing apron 41 having a perforated surface and similar in construction to the spreader table 14 is defined by the rear end portion of the enclosure 40 and provides transition between the spreader table 14 and the conveyor 18. A similar air bearing apron 43 defined by the forward end portion of the enclosure 40 provides transition between the vacuum holddown conveyor 18 and the discharge conveyor 25. The upper run of the conveyor 18 and the enclosure 40 cooperate to define a chamber 42 below the upper run of the conveyor. A vacuum pump 45 connected to the enclosure 40 through a valve 44 facilitates evacuation of air from the chamber 42. The region between the enclosure and the upper run of the conveyor belt is substantially sealed so that air which enters the chamber 42 must flow downwardly through the air permeable upper run of the belt conveyor 18.

The carriage assembly 24, which moves the cutting blade 22 in cutting relation to the layup, includes an X-carriage 48 and a Y-carriage 50. The X-carriage bridges or straddles the conveyor 18 and is supported on longitudinally extending ways 52 and 54, mounted in fixed position at laterally opposite sides of the vacuum holddown table 16, to move longitudinally of the table or in directions parallel to the direction of conveyor movement. An X-drive motor 56 rotates pinions (not shown) which engage stationary longitudinally extending racks 57, 57, located below the ways 52 and 54, respectively, to move the X-carriage in the X-coordinate direction or longitudinally of the conveyor table 14, in a manner well known in the art. The Y-carriage 50 is mounted on the X-carriage 48 and moves with the X-carriage in the X-coordinate direction. The Y-carriage also moves relative to the X-carriage and the vacuum holddown table 16 in the Y-coordinate direction or transversely of the vacuum holddown table in response to operation of a Y-drive motor 60 which drives a lead screw 62 threadably engaged with the Y-carriage. The cutting blade 22 is suspended from the Y-carriage 50 and driven with a vertical reciprocating motion. Another drive motor 64, also mounted on the Y-carriage, rotates the blade 22 about its axis to orient it in a direction generally tangent to the line of cut through the layup. Each of the drive motors 56, 60 and 64 operates in response to signals received from the programmable controller 20, which is programmed to define the contours and positioning of the pattern pieces P, P, which are cut from the layup L in a manner well known in the art.

A suitable control apparatus may be provided for coordinating movement of the carriage assembly in the X-coordinate direction with advancing movement of the conveyor 18 so that the cutting blade may be precisely oriented with respect to the sheet material advanced by the conveyor at the start of each cutting cycle. Such control apparatus is well known in the sheet material cutting art and need not be further considered to enable understanding of the present invention. However, disclosure of a suitable control system for coordinating movement of a conveyor and a carriage assembly is found in my U.S. Pat. No. 4,328,726, previously cited.

Figure 2:
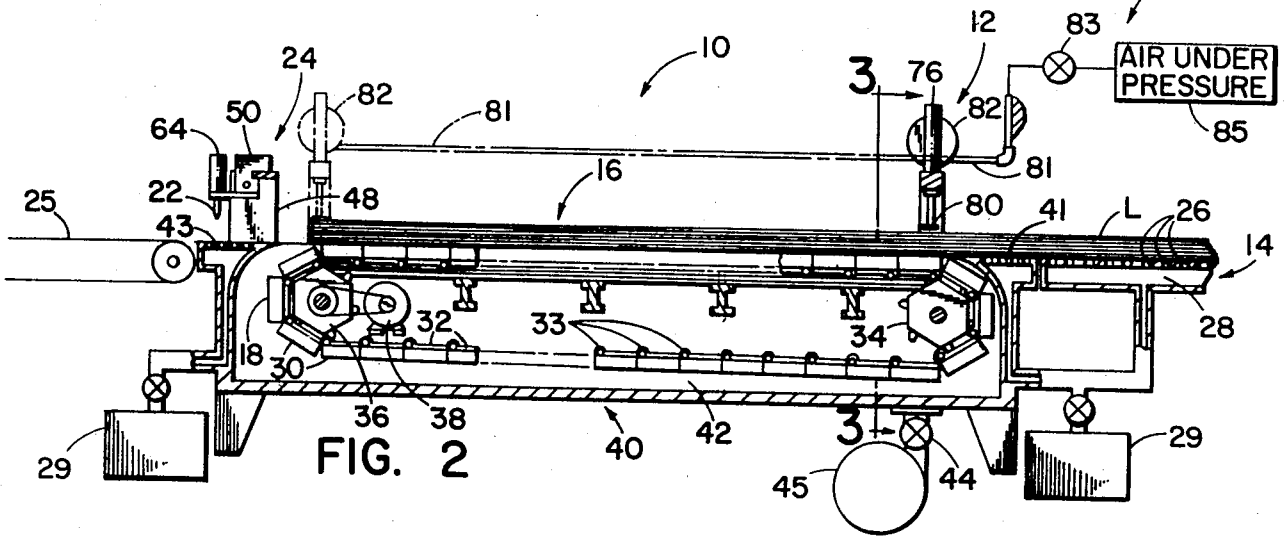
FIG. 2 is a somewhat schematic sectional view taken generally along the line 2—2 of FIG. 1.
Figure 3:
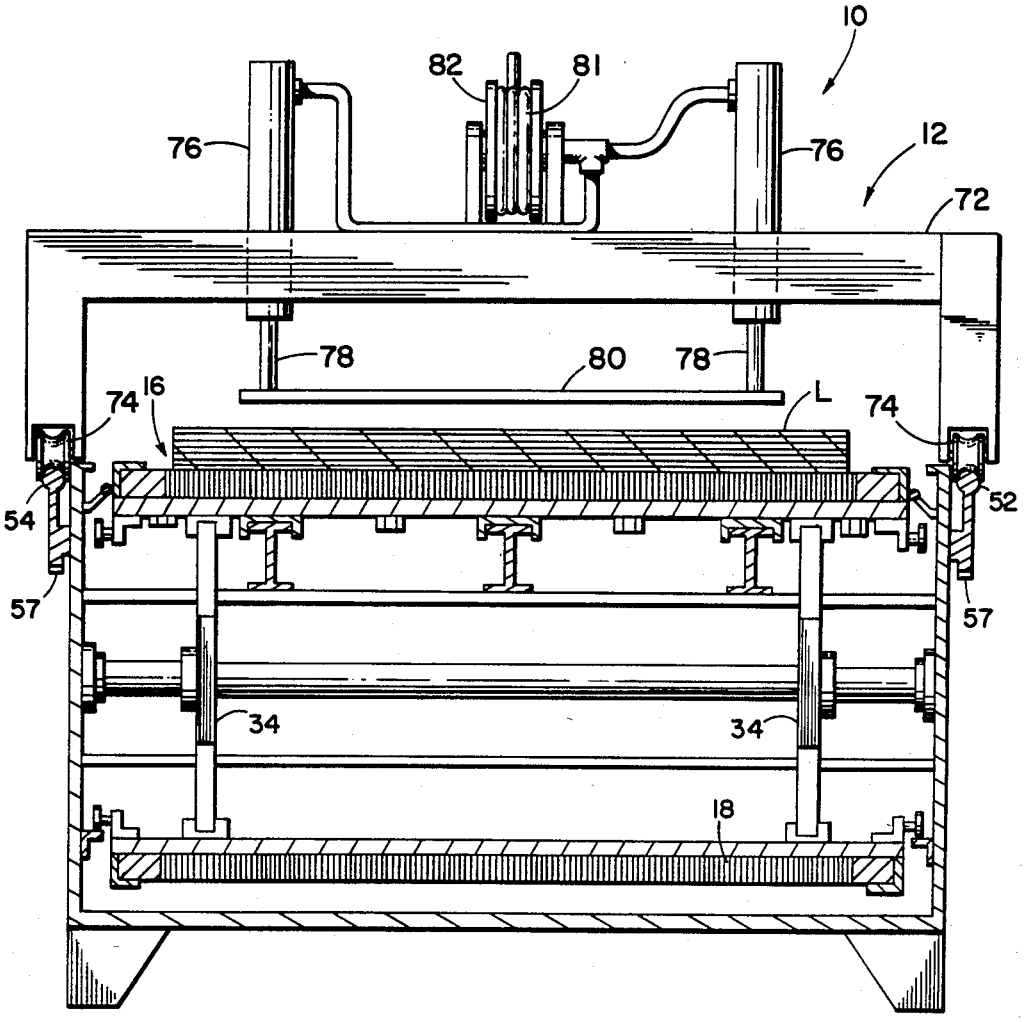
FIG. 3 is a enlarged somewhat schematic sectional view taken along the line 3—3 of FIG. 2 and shows the clamping apparatus in a released position.
Figure 4:
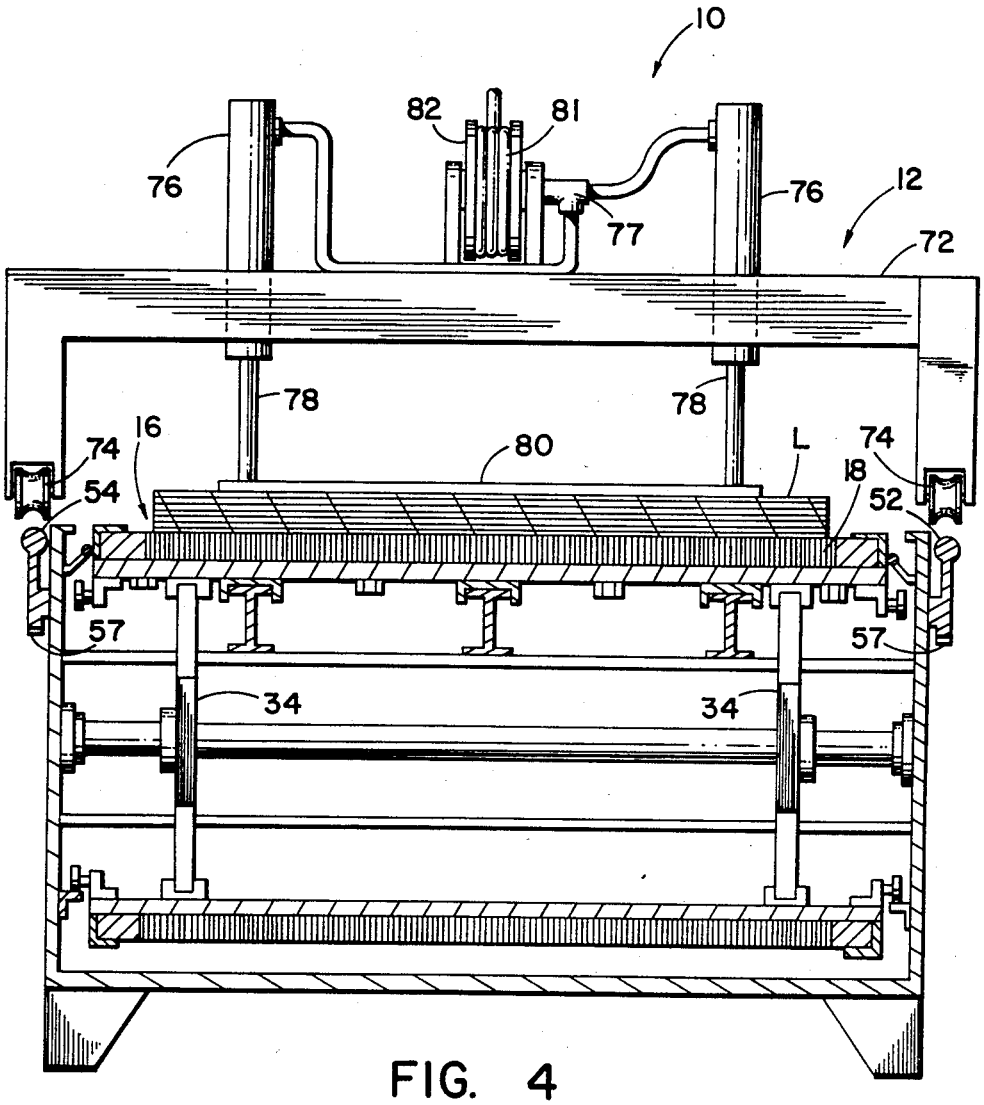
FIG. 4 is similar to FIG. 3 but shows the clamping apparatus in a clamping position.
Figure 5:
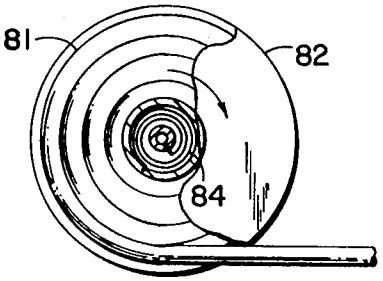
FIG. 5 is a somewhat enlarged fragmentary sectional view taken generally along the line 5—5 of FIG. 1.
Figure 6:
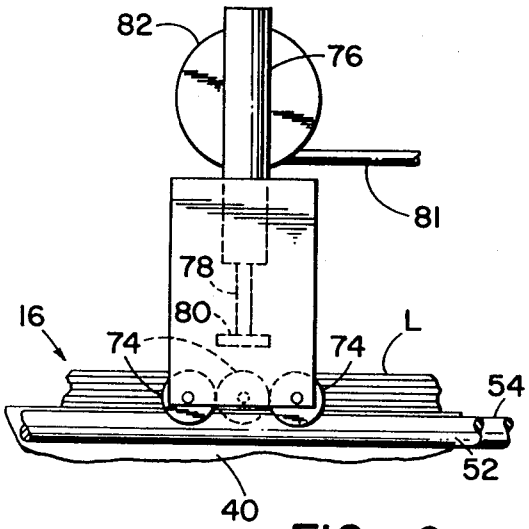
FIG. 6 is a fragmentary side elevational view of the clamping apparatus.

Referring now particularly to FIGS. 3–5, the conveyor loading apparatus 12 comprises a clamping assembly which includes a clamping carriage 72. The clamping carriage straddles or bridges the vacuum holddown table 16 and is supported for movement longitudinally of the table 16 by the longitudinally extending ways 52 and 54. More specifically, the clamping carriage is supported by three annularly grooved rollers 74, 74, journalled on the carriage and which engage the ways. Two of the rollers 74, 74, travel on the way 52. The third roller is disposed in rolling engagement with the way 54. The rollers 74, 74, which are arranged in Delta configuration, as viewed from above (FIG. 2), cooperate with the ways to maintain the clamping carriage 72 in alignment with the vacuum holddown table 16 for free rolling movement longitudinally of the vacuum holddown table or in the X-coordinate direction between a retracted position, wherein the clamping carriage is located at the rear end of the vacuum holddown table 16 near the spreading table 14, and an advanced position, wherein the clamping carriage is located near the forward end of the vacuum holddown table.

A pair of fluid motors or pneumatic cylinder assemblies 76, 76 are mounted in transversely spaced relation to each other on the clamping carriage 72 above the conveyor 18 for moving a clamping element 80 between clamped and released positions relative to the supporting surface of the conveyor. Each cylinder assembly has a cylinder secured in fixed position to the clamping carriage and a piston rod assembly which includes a piston rod 78 supported for reciprocal movement relative to the cylinder. The clamping element 80 comprises a bar which is mounted on the lower end of the piston rods 78, 78, and extends therebetween transversely of the vacuum holddown table 14. The piston rods 78, 78, move the clamping bar 80 generally toward the conveyor 18 and to a clamping position wherein the bar cooperates with the supporting surface defined by the upper run of the conveyor to clamp an associated portion of a layup L to the conveyor. When the clamping bar is in a clamping position the clamping carriage 72 is coupled to the conveyor 18 and moves with it. The piston rods 78, 78 also move the clamping bar 76 away from the conveyor 18 and to a releasing position wherein the clamping bar is out of engagement with the layup L on the conveyor 18 and the clamping carriage 72 is uncoupled from the conveyor.

Fluid or air under pressure for operating the pneumatic cylinder assemblies 76, 76, is supplied to the cylinder assemblies through a flexible conduit 81 wound onto a take-up reel 82 mounted on the clamping carriage. The take-up reel is normally biased to a take-up position with the conduit wound thereon when the carriage assembly is in its retracted position near the rear end of the vacuum holddown table 16. One end of the conduit is connected to the cylinder assemblies 76, 76 through a rotary coupling 77 associated with the reel. The other end of the conduit 81 is secured in fixed position relative to the vacuum holddown table 16 at a location rearward of the holddown table and is connected through a valve 83 to a source of fluid or air under pressure, shown schematically and indicated by the numeral 85. The illustrated reel 82 is spring biased toward wound position. In the drawings (FIG. 2) the takeup reel 82 is biased in clockwise direction to take-up the flexible conduit 81 by a wind-up spring mechanism illustrated schematically and indicated by the numeral 84. The combined weight of the carriage assembly 72 and the take-up reel 82 and conduit 81, which may, for example, be approximately 400 pounds, may serve to effectively limit pressure which may be applied to the conveyor 18 and a layup positioned thereon by a clamping bar having a predetermined clamping area, such as the clamping bar 80, as will be hereinafter further discussed.

Preparatory to cutting pattern pieces P, P, from a layup L, which is somewhat longer than the holddown table 16, the tool carriage assembly 24 is positioned at the forward end of the vacuum holddown table 16 and the clamping carriage 72 is in its retracted position near the rear of the vacuum holddown table 16, as it appears in full lines in FIGS. 1 and 2. After a layup L is formed on the spreading table 14, the leading edge portion of the layup is moved from the spreading table to a position under the clamping bar 80. The air bearing between the upper surface of the spreader table 14 and the lower surface of the layup L minimizes friction therebetween and facilitates movement of the layup relative to the spreader table and the apron 41. When the leading portion of the layup L has been properly positioned relative to the clamping bar 80, the machine 10 is activated to initiate the clamping cycle. The clamping bar 80 moves into clamping engagement with the upper surface of the layup L to clamp the layup between the bar 80 and the support surface of the conveyor 18. The downward force applied to the layup and to the conveyor by the clamping bar 76 is or may be limited by the combined weight of the clamping carriage and its associated take-up reel 82 and conduit. When the applied force reaches this limit, the carriage assembly will be lifted slightly from the ways 52 and 54 which support it, so that the downward force applied to the layup and the conveyor will be substantially equal to the combined weight of the clamping assembly and the wound take-up reel which it carries. This force will, of course, be distributed over the clamping surface area of the clamping bar 80. This arrangement limits the downward force and the friction between the upper run of the conveyor and the conveyor supporting structure therebelow, which comprises a part of the vacuum holddown, table 16. After the layup has been clamped to the conveyor, the conveyor advancing cycle is initiated to advance the layup to the working region of the vacuum holddown table. The clamping assembly 12, which is coupled to the conveyor by the clamping bar acting through the layup L advances with the conveyor 18.

As the clamping assembly advances the flexible conduit 81 is payed-off the take-up reel 82 against the biasing force of the spring mechanism 84 contained within the reel. When the clamping assembly reaches its advanced position, it may, for example, encounter a limit switch or other detecting device (not shown) which provides a signal to the controller to stop the conveyor drive motor 38 and initiate the cutting cycle. However, if the machine 10 includes a control apparatus for coordinating movement of the advancing movement of the conveyor with the movement of the X-carriage, the signals for controlling conveyor movement will originate from the control apparatus. When the conveyor comes to rest with the layup in the cutting region, an electrically operated control valve operates in response to a signal from the controller to exhaust pressure fluid from the cylinder assemblies 76, 76 and return the clamping bar 80 to its released position out of engagement with the layup and out of coupled relation with the conveyor 18. The take-up reel 82, which is biased toward wind-up position, takes up the conduit 81 and simultaneously biases the clamping carriage toward the rear of the vacuum holddown table 16 and to its retracted position. As the clamping carriage 72 rolls freely on the ways and toward its retracted position the tool carriage assembly 24 moves the cutting blade 22 in cutting engagement with the layup L in response to command signals supplied to the motors 56, 60 and 62 by the controller 20 to cut the pattern pieces P, P, in accordance with a predetermined program. Upon completion of the cutting program, the tool carriage 24 may be at the rear of the vacuum holddown conveyor 18 in close proximity to the clamping carriage. The cutting blade moves out of engagement with the layup upon completion of the cutting cycle in response to a command signal from the controller 20. The tool carriage assembly is then returned to its position of origin at the forward end of the machine 10 in response to a command signal which energizes the X-drive motor 56.

While the tool carriage assembly is returning to its position of origin the clamping bar 80 is moved into clamping engagement with a leading portion of the next contiguous segment or bite of the layup. The conveyor drive motor 38 is then energized to simultaneously advance the layup L as the tool carriage is returning to its position of origin. Thus, the time required to advance the layup and to perform the pattern cutting operation is minimized. Since the clamping assembly is advanced by the conveyor 18 and retracted by the flexible conduit 81 and reel mechanism 82, a drive motor is not required for moving the conveyor loading apparatus 12 between its advanced and retracted positions.

Figure 7:
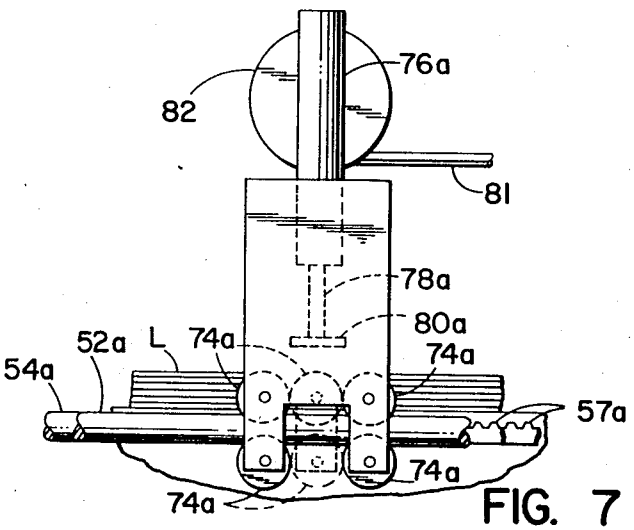
FIG. 7 is similar to FIG. 6 but shows another embodiment of the invention.

In some machine installations it may be desirable to apply a downward force to the clamping element which exceeds the weight of the clamping carriage assembly. Such a modified form of conveyor loading apparatus is illustrated in FIG. 7 and indicated generally by the reference numeral 12*a*. Parts of the loading apparatus 12*a* which correspond to parts of the apparatus 12, previously described, bear the same reference numerals used in the description of the previous embodiment with a letter "a" suffix and will not be hereinafter further described.

The conveyor loading apparatus 12*a* is shown supported on a conveyor table 16*a* which includes a conveyor 18*a* and longitudinally extending ways 52*a* and 54*a* which are supported at laterally opposite sides of the table. Racks 57*a*, 57*a* which cooperate in driving relation with the X-carriage of a tool carriage assembly (not shown) are mounted on the table 16 inboard of the ways 52*a* and 54*a*.

Like the loading apparatus 12, the apparatus 12*a* includes a clamping carriage 72*a* supported by three annularly grooved rollers 74*a*, 74*a* journalled on the carriage and engaging the upper surfaces of the ways 52*a* and 54*a*. The conveyor loading apparatus 12*a* also includes three annularly grooved retaining rollers 74*a*', 74*a*' arranged in vertically opposing relative to the rollers 74*a*, 74*a* and journalled on the carriage 72*a* below the ways 52*a* and 54*a* to engage the lower surfaces of the ways. A clamping bar 80*a* is moved into and out of clamping relation with a layup of sheet material supported on the conveyor 18*a* by a pair of fluid motor assemblies 76*a*, 76*a* mounted on the clamping carriage 72*a*.

The retaining rollers 74*a*', 74*a*' engages the ways 52*a* and 54*a* to prevent the clamping carriage 72*a* from being lifted off the ways when the downwardly directed force exerted upon the clamping bar by the fluid motors exceeds the weight of the clamping carriage assembly. A presure regulator (not shown) may, if desired, be provided for regulating the pressure fluid supplied to the fluid motors 76*a*, 76*a* to control the downward force applied to the clamping bar 80*a*.

I claim:

1. A machine for working on sheet material and comprising conveying means for advancing sheet material received from a spreading table and including an elongated conveyor defining a longitudinally extending movable sheet material support surface, and conveyor loading means for releasably securing sheet material to the support surface to move with the support surface and from the spreading table onto said support surface, said conveyor loading means including a clamping carriage, means for supporting said clamping carriage for free longitudinal directional movement relative to said conveyor, a clamping element carried by said clamping carriage, means for moving said clamping element toward said support surface and to clamped position wherein said clamping element is engageable with sheet material on said support surface to clamp the sheet material to said support surface and couple said clamping carriage to said support surface to move with said support surface and to a released position wherein said clamping element is out of engagement with the sheet material and said clamping carriage is uncoupled from said conveyor, said clamping carriage being advanced by and with said conveyor from a retracted position to an advanced position when said clamping element is in its clamping position, and biasing means for urging said clamping carriage toward its retracted position when said clamping element is in said released position, said biasing means being formed by a part of said means for moving said clamping element.

2. In a machine for working on sheet material as set forth in claim 1 the further improvement wherein said means for moving said clamping element comprises a fluid motor and flexible conduit means connected to said motor for supplying pressure fluid to said motor and said flexible conduit means comprises said part of said means for moving said clamping element.

3. In a machine for working on sheet material as set forth in claim 2 the further improvement wherein said biasing means includes a reel normally biased toward a wound condition and a portion of said flexible conduit is wound onto said reel when said reel is in said wound condition.

4. In a machine for working on sheet material as set forth in claim 3 the further improvement wherein said reel is carried by said clamping carriage and a portion of said flexible conduit is secured in fixed position relative to said spreading table.

5. In a machine for working on sheet material as set forth in claim 1 wherein said machine includes a tool carriage and means for supporting said tool carriage for longitudinal directional movement relative to said conveyor, the further improvement wherein said means for supporting said tool carriage comprises said means for supporting said clamping carriage.

6. In a machine for working on sheet material as set forth in claim 5 the further improvement wherein said means for supporting said tool carriage comprises longitudinally extending ways at opposite sides of said conveyor.

7. In a machine as set forth in claim 6 the further improvement wherein said means supporting said clamping carriage comprises support rollers journalled on said clamping carriage and engaging the upper surfaces of said ways.

8. In a machine for working on sheet material as set forth in claim 7 the further improvement wherein said support rollers comprise three support rollers.

9. In a machine for working on sheet material as set forth in claim 8 the further improvement wherein said rollers are arranged in delta configuration.

10. In a machine for working on sheet material as set forth in claim 6 the further improvement wherein said clamping assembly includes a plurality of retaining rollers journalled on said clamping carriage for engaging the lower surfaces of said ways.

11. A machine for working on sheet material and comprising means for defining a longitudinally movable sheet material support surface, loading means for releasably securing sheet material to the support surface to move with the support surface, said loading means including a clamping carriage, means for supporting said clamping carriage for free longitudinal directional movement relative to said support surface, a clamping element carried by said clamping carriage, and means for moving said clamping element toward said support surface and to clamped position wherein said clamping element is engageable with sheet material spread on said support surface to clamp the sheet material to said support surface and couple said clamping carriage to said support surface to move with said support surface and to a released position wherein said clamping element is out of engagement with the sheet material and said clamping carriage is uncoupled from said support surface, said means for moving said clamping element including a fluid motor having a fixed part connected to said clamping carriage and a movable part carrying said clamping element, a flexible conduit connected to said fluid motor for supplying pressure fluid to said motor to operate said motor, a reel carried by said clamping carriage, means for biasing said reel toward a wound condition, said flexible conduit being wound onto said reel when said reel is in its wound condition, said clamping carriage being advanced by and with said support surface from a retracted position to an advanced position when said clamping element is in its clamping position, said flexible conduit, said reel and said reel biasing means cooperating to urge said clamping carriage toward its retracted position when said clamping element is in said released position.

12. In a machine for working on sheet material as set forth in claim 11 the further improvement wherein said means for supporting said clamping carriage comprises longitudinal extending ways at opposite sides of said support surface and support rollers journalled on said clamping carriage and engaging only the upper surfaces of said ways.

13. In a machine for working on sheet material as set forth in claim 12 the further improvement wherein said support rollers comprise three support rollers.

14. A machine for working on sheet material and comprising means for defining a longitudinally movable sheet material support surface, loading means for releasably securing sheet material to the support surface to move with the support surface, said loading means including a clamping carriage, means for supporting said clamping carriage for free longitudinal directional movement relative to said support surface, a clamping element carried by said clamping carriage, and means for moving said clamping element toward said support surface and to clamped position wherein said clamping element is engageable with sheet material spread on said support surface to clamp the sheet material to said support surface and coupled said clamping carriage to said support surface to move with said support surface and to a released position wherein said clamping element is out of engagement with the sheet material and said clamping carriage is uncoupled from said support surface, and biasing means for urging said clamping carriage toward its retracted position when said clamping element is in said released position, said biasing means being formed by a part of said means for moving said clamping element.

* * * * *